United States Patent [19]

Hahlbrock

[11] 3,995,439

[45] Dec. 7, 1976

[54] DEVICE FOR EMBEDDING OBJECTS SUCH AS CONTINUOUS PIPES INTO WATER BOTTOMS

[75] Inventor: Udo Hahlbrock, Hannover, Germany

[73] Assignee: O & K Orenstein & Koppel Aktiengesellschaft, Germany

[22] Filed: Mar. 3, 1975

[21] Appl. No.: 554,662

[30] Foreign Application Priority Data

Mar. 8, 1974 Germany ..... 2411140

[52] U.S. Cl. ..... 61/72.4; 37/65

[51] Int. Cl.[2] ..... E02F 5/06

[58] Field of Search ..... 61/724, 72.1, 72.3; 37/86, 87, 64, 65

[56] References Cited

UNITED STATES PATENTS

| | | | |
|---|---|---|---|
| 3,103,790 | 9/1963 | Popich | 61/72.4 |
| 3,429,131 | 2/1969 | Martin | 61/72.4 |
| 3,590,589 | 7/1971 | Smulders | 61/72.4 |
| 3,732,701 | 5/1973 | Lynch | 61/72.4 |
| 3,857,250 | 12/1974 | Di Tella | 61/72.4 |

*Primary Examiner*—Jacob Shapiro
*Attorney, Agent, or Firm*—McGlew and Tuttle

[57] ABSTRACT

A device for embedding objects such as continuous pipes into water bottoms comprises a support frame which is movable along the bottom on a drive track which is carried adjacent one side thereof. The support frame also carries a plurality of guide and drive rollers which are engageable with the object to be embedded and which engage the object to move the support frame along the object as the drive track advances along the water bottom. A bottom trenching device in the form of a ground mill with a rotatable cutting head is pivotally mounted on a support between the drive rollers and the drive track and it operates on the bottom to remove material therefrom to form a trench. The material may be subsequently directed backwardly over the object to be embedded after it is positioned in the trench.

15 Claims, 8 Drawing Figures

DEVICE FOR EMBEDDING OBJECTS SUCH AS CONTINUOUS PIPES INTO WATER BOTTOMS

BACKGROUND OF THE INVENTION

1. Field Of The Invention

This invention relates in general to devices for positioning objects on water bottoms or seat beds and in particular to a new and useful device for embedding endless pipe into seat bottoms and which includes means for guiding a support member along the pipe as the support member is moved along the bottom by an endless track drive and as a trench is formed behind the support member during its movement.

2. Description Of The Prior Art

Devices for embedding pipes into the sea beds are known in which the supporting structure supports a scraper chain which is located laterally of the pipe to be embedded and it can be lowered by mechanism pivotable about a horizontal axis. The supporting structure also supports a dredge pump provided with a suction snout which either alone or along with the scraper chain digs a trench. On its side opposite to the scraper chain the supporting structure is provided with a bracket carrying two supporting rollers through which the supporting structure bears unilaterally against the water bottom. On the other side the supporting structure bears against the pipe to be embedded through horizontally mounted supporting rollers which may be driven. At both its forward and rear ends considered in the travel direction the supporting structure is equipped with a pair of guide rollers having vertical axes and which apply laterally against the pipe to be embedded. Such a drive through the horizontally mounted supporting rollers is unsatisfactory. It is in no way insured that the friction grip will be sufficient for a trouble free advance of the supporting structure. A determining factor for the friction grip is the weight of the device which must not exceed a certain value which is set by the stress characteristics of the pipe to be embedded. The risk of damaging the pipe to be embedded increases with the total weight of the support structure which is carried by the pipe and the contact rollers which apply laterally against the pipe serve only to effect some stabilization of the device. A device of this nature is described in U.S. Pat. No. 3,590,589.

Another known device for burying pipe lines laid under water which can be lowered onto and moved along the pipe lines to be buried is provided with a mechanism for cutting a trench in the form of one or more jet openings for hydraulic lines. The hydraulic cutting mechanisms are located on both sides of the pipe to be embedded and carried by a supporting structure which is provided with pontoon skids on each side of the pipe to be embedded and extend along the axis of the latter and are equipped with abrasion sheathing at their undersides. The forward ends of the pontoon skids are connected to the bow of a vessel by means of traction ropes by which the supporting structure is towed over the sea bottom. In addition the supporting structure is provided with horizontally and vertically mounted guide rollers which apply against the pipe to be embedded. The device is advanced exclusively by a tugboat. Therefore neither a uniform nor a sure advance is provided since the motion of the boat depends on the surface streams and the wind. The towed device is exposed to uncontrollable varying tension stresses and this may lead to damaging of the device. The difficulties described above are particularly acute when the device is used in deep areas of the sea.

Another known device for embedding pipes in the sea beds includes a cutting mechanism which comprises two internal suction cutter heads which are mounted on a supporting structure laterally of the pipe to be embedded and are adapted to be lowered and swung inwardly. The suction conduit ends approximately in the middle zone of the cutting heads and these cutting heads are equipped with spiral shaped cutting blades. The cutting heads are operated hydraulically. The suction lines lead to a suction pump which is mounted on the vessel. The supporting structure of the suction heads bears against the pipe to be embedded through supporting rollers having inclined axes extending in a plane perpendicular to the travel direction. The supporting rollers are driven. A disadvantage of this device is that the total weight of the device must be absorbed by the pipe to be embedded. The mounting of the dredge pump on the vessel and the provision of a relatively long suction line is disadvantageous. In addition there is no possibility of stabilizing the digging device. Such a device is described in U.S. Pat. No. 3,429,132.

There are also known devices of this kind in which the supporting structure for a trenching mechanism is supported by two endless track drive gears which can be advanced under water bottoms on each side of the pipe to be embedded. Two bracket arms joined in the space between the drive gears and carrying the drive for the cutting tools on their ends are pivoted to the drive gears. The cutting tools comprise cutting and suction heads and the drive axes are inclined so that below the pipe the suction and heads are closely adjacent to each other. In addition the suction and cutting heads are pivotally supported about axes extending in the travel direction so that the cutting mechanism can be removed from the trench to be cut both by swinging the bracket arms and by lateral swinging of the heads. Two swinging motions are necessary in order to effect this. In addition the drive is provided with a device permitting the control of the depth of the trench to be cut as a function of the diameter of the pipe to be embedded. For this purpose laterally inclined rollers are mounted on the swing arms which apply against the pipe to be embedded. A horizontal guide roller is further provided which is carried by a support to which the automatically controlled lateral rollers are pivotally connected. Due to the use of two endless track drive gears the device is very expensive. This is especially true if pipes having a larger diameter are to be embedded. The design of the device results in a heavy weight which is again a disadvantage as the device has to be supported by the pipe to be embedded. Such a device is described in U.S. Pat. No. 3,583,170.

SUMMARY OF THE INVENTION

This invention provides an improved device for embedding objects such as continuous pipes into water bottoms which is of simple design and has a small weight and is operable easily and reliably. The device is particularly advantageous for embedding pipes having large diameters such as pipelines in sea bottoms. In particular a device is provided which is capable of advancing along the bottom in a completely satisfactory manner and independently of any tugboat. The device is capable of advancing in the correct direction and to effect a proper embedding of the pipe without a continuous localization and direction control from the vessel effecting the pipe laying. The device is capable of being lowered into the correct position and lifted again without difficulty. In addition an easy maintenance is required and this is of particular importance for the use in great sea depths. The power consumption of the device is also relatively small.

In accordance with the invention the device includes a support member having guide rollers which engage with the pipe to be embedded. At least some of the guide rollers are driven rollers which are applied by friction grip against the pipe to be embedded so that the support structure is advanced along the pipe. In addition the supporting structure is provided with a drive track which engages with the sea bottom and advances therealong during the advancement of the rollers along the pipe. In addition the support structure carries a downwardly directed ground mill which is mounted on a supporting arm between the drive track and the drive rollers. The construction provides a device which is simple in design and is light in weight and easy to operate and consumes very little power. The device is independent of a towing vessel and does not stress the pipe to be embedded. The lowering and placement of the device on the sea bottom is very simple to effect and during the embedding operation the device may be arranged to follow over the pipe which is positioned in advance.

The drive rollers carried on the support structure are mounted so as to be pivotable about an axis extending in a travel direction above the pipe to be embedded. The rollers are hydraulically adjustable so that the frictional engagement with the pipe may be easily controlled. Such a design has the advantage that the contact pressure of the drive roller is adjustable and for removing the device it suffices to swing the drive rollers upwardly away from the pipes. Friction grip of the rollers can be adjusted to the various operational conditions.

According to another development of the invention the drive rollers are mounted at mutually opposite locations symmetrically at both sides of the pipe to be embedded and they are operated by pivot drives on equal adjustable hydraulic supply pressure. Measuring instruments are provided for determining the pressure differences produced during the operation and for using them for controlling the drive engagement. This embodiment has the advantage that disturbances which might lead to an incorrect travel direction are immediately recognized and eliminated. If for example due to unforseen irregularities of the bottom or the like the advance would be deviated from the correct travel direction, the deviation is determined by the measuring instruments in the form of pressure differences which are then used for compensation control of the drive so that the device is returned to the correct direction given by the position of the pipe.

According to a further advantageous arrangement two or more drive rollers are mounted symmetrically at each side of the pipe to be embedded and they are carried on a hydraulically pivotal frame. The frame may be adjusted hydraulically in order to vary the loading of the rollers against the pipe and to effect a controlled loading in the longitudinal direction. This arrangement facilitates the running past of indentations such as welding zones or the like without a disturbant diminution of the frictional grip of the rollers.

In order to prevent the drive and guide rollers from running off the pipe to be embedded the axes of the drive rollers are advantageously inclined in the travel direction plane forwardly relative to the vertical. Such an oblique position results in an additional downwardly directed motion component.

The inventive device may be further improved by providing the supporting structure with guide rollers in addition to the drive rollers which contact the pipe to be embedded under frictional grip and which also apply against the pipe. Another feature of the invention is that the supporting rollers supporting the support structure on the pipe to be embedded are mounted in the zone of the drive and guide rollers. With such an arrangement the forces acting on the pipe in the horizontal and vertical directions are approximately equal to each other so that a favorable general utilization of the strength properties of the pipe is insured.

In order to reduce the contact pressure of the device for forming a trench in the sea bed, the mill head which is provided with the invention for cutting out the trench is provided with a mounting on a support arm so that its axis is inclined in a vertical plane extending in the travel direction relative to the vertical so that the lower part of the ground mill is advanced in respect to the travel direction. In order to simplify the operation of the device the axis of the ground mill may be inclined in a plane perpendicular to the travel direction in a manner such that the cutting head undercuts the water bottom in the zone of the pipe to be embedded. Due to this provision the pipe can sink into the digging trench by its own weight alone without further auxiliary means.

In a further development of the invention the ground mill is mounted on the supporting structure by means of a supporting arm which extends in the direction opposite to the travel direction and at a location outside the zone of the supporting drive and guide rollers and of the ground track drive. Thereby it is insured that the ground track drive keeps off the zone of the trench and disturbances are minimized. In addition due to this arrangement the lateral forces acting on the device and resulting from the moment of the cutting head are reduced. In accordance with a further development of the invention the supporting arm is mounted on the supporting structure so that it may be pivoted about an axis which makes it possible to swing the ground mill upwardly. The pivotal axis may extend obliquely relative to the horizontal so that while swinging of the supporting arm upwardly the ground mill may be swung at the same time laterally away from the pipe to be embedded. Consequently the ground mill can be brought into its operative position or withdrawn from this position by a single movement. In the upwardly swung position of the ground mill, the cutting part of the mill is accessible for divers so that for maintenance work on this part it is not necessary to surface the entire device.

In order to prevent the device from running off the pipe due to unevenness of the bottom, the supporting drive and guide rollers extending in the travel direction may be distributed in two groups mounted on the forward and rear portions of the supporting structure so as to form along with the ground track drive a triangle of support. In order to advantageously relieve the pipe to be embedded from the load it is useful to mount the dredge pump on the supporting structure near the ground track drive gear so that the weight of the dredge pump is transmitted to the bottom of the sea bed mainly by the ground track drive gear.

Accordingly it is an object of the invention to provide an improved device for embedding objects such as continuous pipes in water bottoms which comprises a suport frame having a drive track engageable with the water bottom to advance the frame therealong and which includes guide and drive rollers which are engageable with the pipe to be laid and advance the support from over the pipe as it moves along the sea bottom and which also includes a bottom trenching device carried on the frame which is engageable in the water bottom to form a trench for the object to be embedded as the frame is advanced along the bottom.

A further object of the invention is to provide a device for embedding pipes in sea beds which comprises a support which is movable along the pipe to be embedded and which has a ground engagement track which is movable along the sea bed and which may be controlled for accurate movement along the pipe by controlled pressure of the guide rollers of the support on the pipe and which also includes a ground mill which is pivotally mounted on a support arm between the ground track and the pipe engaging rollers in a position to form a trench behind the support during its movement along the sea bed.

A further object of the invention is to provide a device for embedding objects in water bottoms which is simple in design, rugged in construction and economical to manufacture.

For an understanding of the principles of the invention reference is made to the following description of typical embodiments thereof as illustrated in the accompanying drawings.

GENERAL DESCRIPTION OF THE PREFERRED EMBODIMENTS

Figure 1:
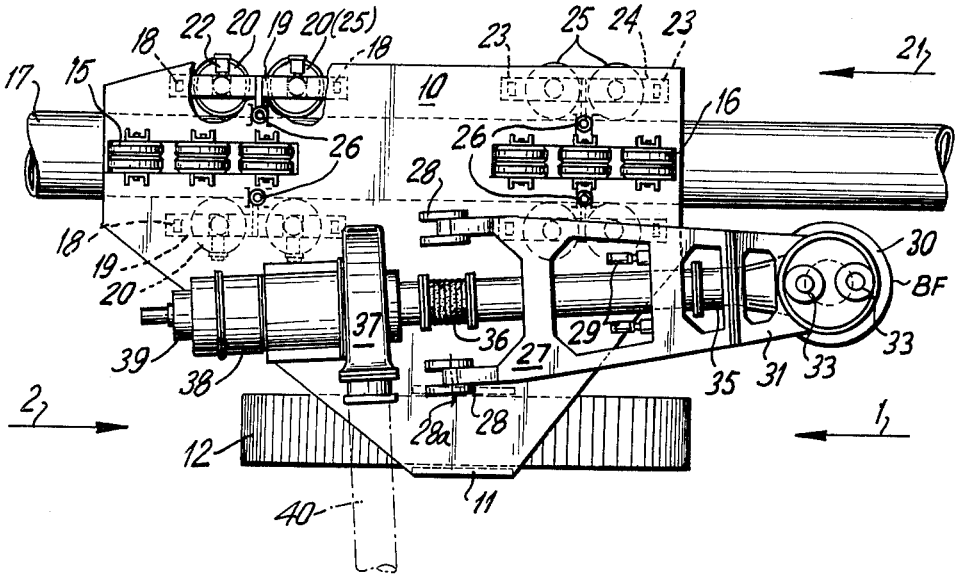
FIG. 1 is a top plan view of the device for embedding pipes in water bottoms which is constructed in accordance with the invention.
Figure 2:
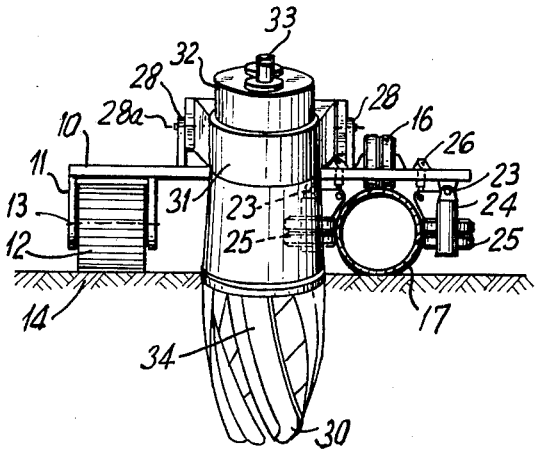
FIG. 2 is an end elevational view of the device shown in FIG. 1 taken in the direction of the arrow 1 shown in FIG. 1.

Referring to the drawings in particular the invention embodied therein as indicated in FIGS. 1 to 4 comprises a supporting structure 10 which is adapted to be moved along a water bottom by guiding it along a pipe 17 to be embedded in the bottom. In addition the support structure 10 is supported on a bracket 11 of an endless track drive gear 12 on horizontal bearings 13 carried by the bracket. The drive gear is hydraulically operated and runs on the sea bottom 14.

In accordance with the invention the supporting structure 10 is supported on the pipe 17 to be embedded through horizontally mounted supporting rollers 15 and 16 which are distributed in two groups located adjacent said forward and rear ends respectively of the supporting structure 10. Each group of rollers 15 and 16 comprises three twin rollers.

Figure 3:
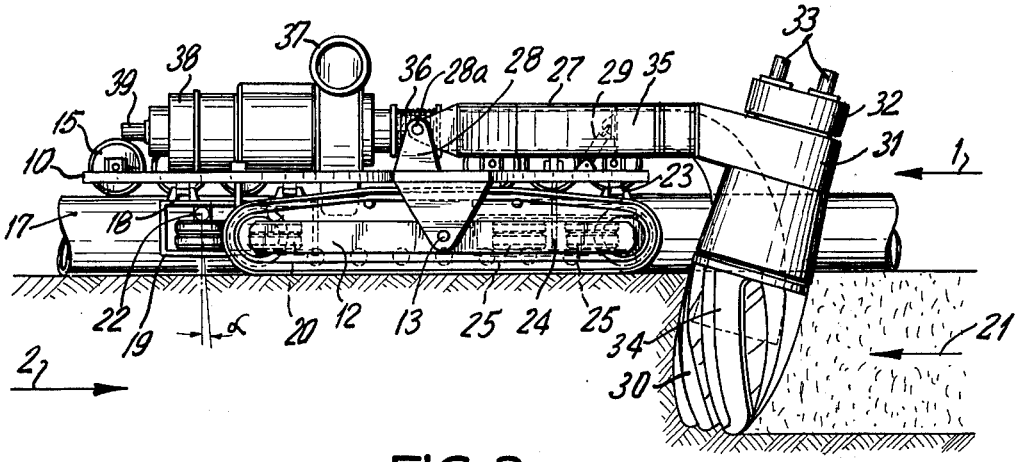
FIG. 3 is a side elevational view of the device shown in FIG. 1.
Figure 4:
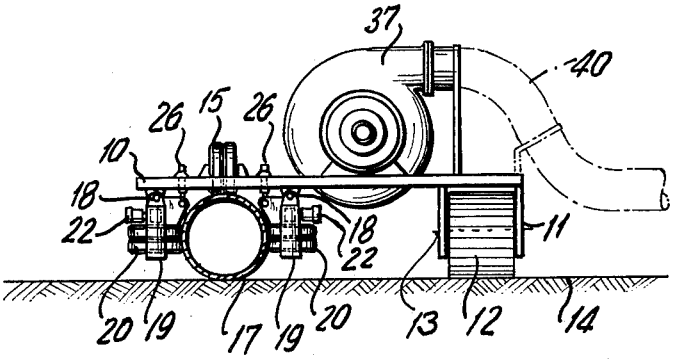
FIG. 4 is a front elevational view of the device shown in FIG. 1 taken in the direction of the arrow 2 shown in FIGS. 1 and 3.
Figure 5:
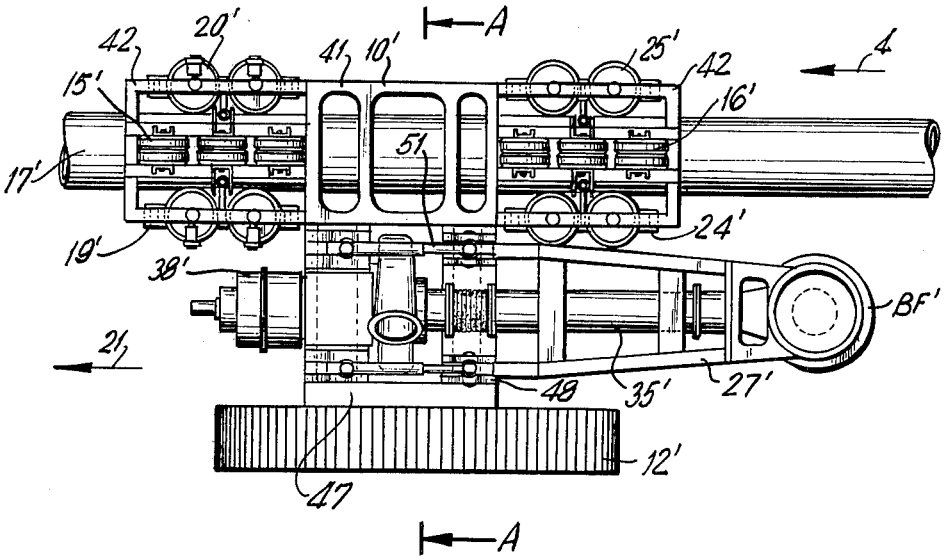
FIG. 5 is a top plan view of another embodiment of the invention.

Frames 19 and 24 are mounted below the supporting structure 10 on both sides of the pipe 17 to be embedded and they are pivotable about horizontal axes 18 and 23 respectively. Each frame 19 and 24 carries two sets of guide roller means 2C and 25 respectively and each set comprises two twin rollers. The guide rollers mounted on the forward portion of the supporting structure 10 as considered in the travel direction indicated by the arrow 21 are designed as drive rollers 20 which are driven through hydraulic motors 22. Each drive roller 20 is provided with its own drive motor which may be hydraulic motor 22 as indicated or an electric motor. The shaft of the drive rollers 20 and of the guide rollers 25 are mounted on frames 19 and 24 in a position which is inclined forwardly in the plane of the travel direction so that during the advance of the device the rollers produce a downwardly directed motion component. In FIG. 3 an angle of inclination of the axes of the rollers 20 are indicated.

Frames 20 and 24 are pivoted by pivot drives 26 which advantageously comprise hydraulic piston and cylinder sets which effect the necessary contact pressure for the drive and guide rollers in respect to the pipe 17. Pressure differences produced during operation of the guide rollers in contact with the pipe 17 are masured by measuring instrument (not shown) and used to control the hydraulic devices which position these rollers on the pipe 17. In this way the movement of the device along the pipe 17 is always controlled.

Supporting brackets 28 are also carried on the support structure 10 and they mount the supporting arm 27 which may be pivotable about a horizontal axis 28*a* on the bracket. The supporting arm 27 includes an outer end with a trenching device in the form of a ground mill BF for digging the trench. Supporting arm 27 may be pivoted upwardly and downwardly about the axis 28 under the control of two hydraulic cylinders 29 which are also supported by the supporting structure 10.

The ground mill BF comprises a cutting head 30 which is driven by two hydraulic motors 33 through gearing 32 which is supported by a carrier 31. The suction mouth 34 is defined within the cutting head 30 and it has a concentrical cross-section and is connected through a suction tube 35 disposed in the supporting arm 27 through a flexible tube 36 to a dredge pump 37 which is also mounted on the support structure 10. A dredge pump 37 is connected to the suction tube 35 and it is driven by a hydraulic motor 39 through gearing 38. The pump 37 transports the material which is loosened by the cutting head 30 through the suction conduit 35 and through a delivery pipe 40 to a location laterally of the device or by means of auxiliary equipment which is not shown to a location behind the device where the pipe already reposes in the trench bottom.

Figure 6:
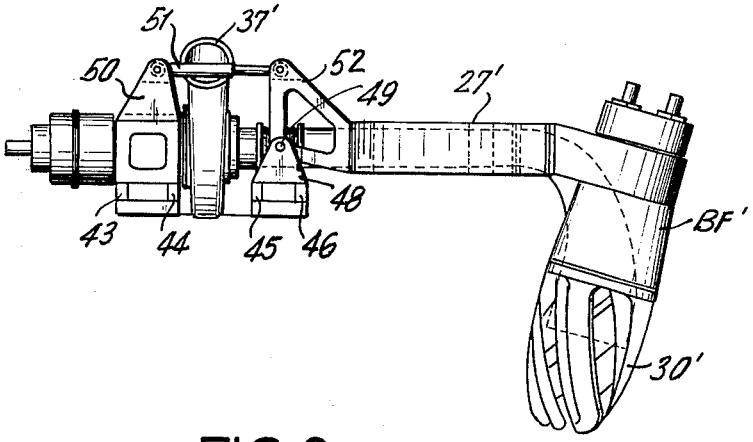
FIG. 6 is a partial side elevational view of the device shown in FIG. 5 taken in the direction of the arrow 4 shown in FIG. 5.
Figure 7:
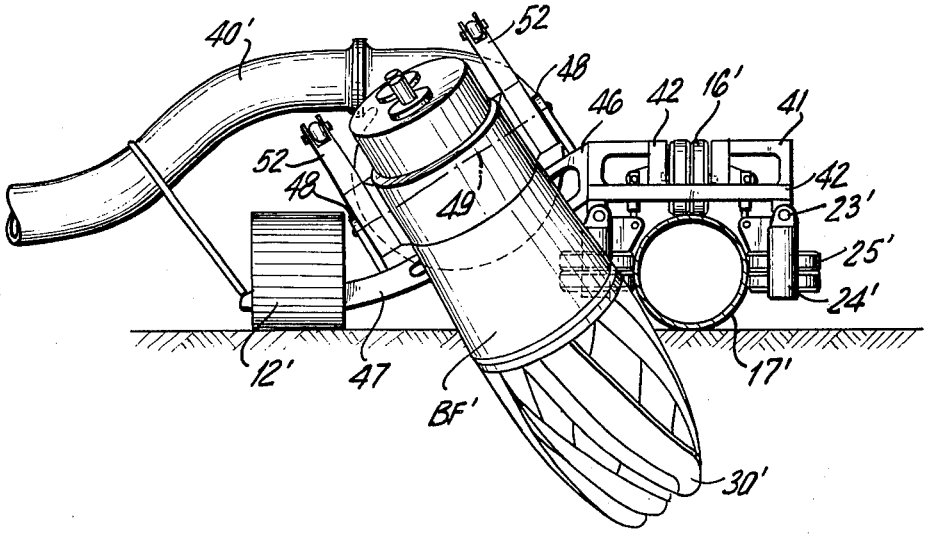
FIG. 7 is an end elevational view of the device shown in FIG. 5 taken in the direction of the arrow 4.
Figure 8:
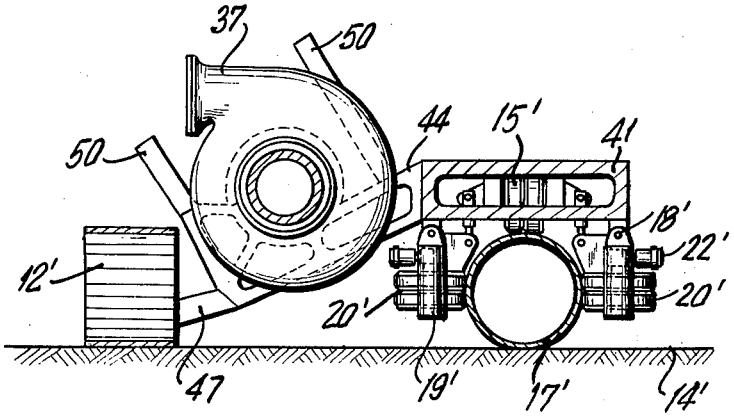
FIG. 8 is a section taken along the line A—A of FIG. 5.

In the embodiment of the invention shown in FIGS. 5 to 8 similar parts are similarly designated but with primes. In this embodiment the supporting structure 10′ comprises a box beam 41 made of shaped plates and carrying at its forward and rear ends support frames 42 which serve to receive the supporting drive and guide component parts which have been described in connection with FIGS. 1 to 4. The supporting structure 10' is supported on a ground engagement track through transverse frame members 43, 44, 45 and 46 which are connected to each other by a cross member 47. For this purpose cross member 47 is mounted for pivoting about a horizontal axis (not shown). Frame members 43, 44, 45 and 46 have upper portions which extend in the direction which is inclined downwardly toward the cross member 47. Supporting brackets 48 are mounted on the upper inclined sides of the frame members for supporting support arm 27' of the ground mill BF' which is pivotable about axis 49. Since the axis 49 is inclined in the horizontal position of the supporting arm 27 as shown in FIG. 6 and FIG. 7, the cutting head 30' undercuts the pipe to be embedded so that the trench which is dug extends directly below the pipe to be embedded.

The frame members 43 and 44 are designed as carriers of the supporting bracket of the dredge pump 37. In addition they carry supporting brackets 50 for two hydraulic cylinders 51 pivoted thereto which are connected to the trapezoidally shaped end 52 of the supporting arm 27 and serve for the lifting and lowering of the ground mill BF. The inventive device presupposes the use of a supply vessel carrying equipment for the power supply, the control and the lowering and surfacing operations.

While specific embodiments of the invention have been shown and described in detail to illustrate the application of the principles of the invention, it will be understood that the invention may be embodied otherwise without departing from such principles.

What is claimed is:

1. A device for embedding objects such as continuous lengths of pipes on water bottoms, comprising a support frame, a single drive track carried by said support frame along one side and engageable with the water bottom to advance said frame along the bottom, pipe drive roller means on said frame spaced laterally of said drive track and including at least one drive roller frictionally engageable with the object to be embedded for advancing said frame therealong as said drive track moves said frame relative to the water bottom, and a bottom trenching device carried on said frame and being engageable in the water bottom to form a trench for the object to be embedded as said frame is advanced along said bottom and said object.

2. A device according to claim 1, wherein said bottom trenching device comprises a ground mill with a rotatable head and it is located between said drive track and said drive roller means.

3. A device according to claim 1, wherein said drive roller means comprises a plurality of groups of rollers arranged at spaced locations along the length of said object to be embedded, pivot support means carrying said drive rollers about an axis extending in the travel direction above the object to be embedded, and hydraulic means connected to said support means for shifting said support means for varying engagement of said drive rollers with the object to be embedded.

4. A device according to claim 1, wherein said drive roller means comprises a plurality of sets of drive rollers arranged at respective opposite sides of said object to be embedded, a hydraulically pivotable frame carrying said drive roller sets being adjustable to vary the amount of frictional engagement of said drive roller sets with the object to be embedded.

5. A device according to claim 4, wherein the drive rollers are mounted on axes which are inclined in the travel direction plane forwardly by an angle relative to the vertical.

6. A device according to claim 1, wherein said drive roller means includes a plurality of drive rollers which are rotatably driven applied against the object to be embedded by frictional engagement and a plurality of guide rollers bearing against the object to be embedded.

7. A device according to claim 1, wherein said drive roller means comprises a plurality of sets of frames each carrying at least one roller engageable with the object to be embedded from each side thereof and from the top thereof at least some of said rollers having their own driving motor.

8. A device according to claim 1, wherein said bottom trenching device comprises a ground mill having a rotor with an axis which is inclined in a vertical plane extending in a travel direction with the lower part of the rotor being advanced in the travel direction in respect to the upper part.

9. A device according to claim 7, wherein said rotor axis is inclined inwardly toward the object to be embedded so that it excavates below the object.

10. A device according to claim 1, including a pivot on said support structure, a supporting arm pivotally mounted on said support structure and carrying said bottom trenching device, said bottom trenching device comprising a rotatable ground mill having a rotor rotatable about an inclined substantially vertical axis, said supporting arm being movable upwardly to lift the ground mill off said bottom.

11. A device according to claim 1, including a dredge pump mounted on said supporting structure, said bottom trenching device comprising a rotatable ground mill having suction means connected to said dredge pump, the weight of the dredge pump being supported on said support structure and being transmitted to the bottom mainly through said drive track.

12. A device for embedding objects such as continuous lengths of pipes on water bottoms, comprising a support frame, a drive track carried by said support frame and engageable with the water bottom to advance said frame along the bottom, pipe drive roller means on said frame spaced laterally of said drive track and including at least one drive roller frictionally engageable with the object to be embedded for advancing said frame therealong as said drive track moves said frame relative to the water bottom, and a bottom trenching device carried on said frame and being engageable in the water bottom to form a trench for the object to be embedded as said frame is advanced along said bottom and said object, said bottom trenching device comprising a ground mill having a rotor with an axis which is inclined in a vertical plane extending in a travel direction with the lower part of the rotor being advanced in the travel direction in respect to the upper part, a supporting arm on said support structure carrying said ground mill so as to position said ground mill outside said supporting structure, said guide roller means being carried on said support structure in alignment with said drive track.

13. A device for embedding objects such as continuous lengths of pipes on water bottoms, comprising a support frame, a single drive track carried on one side of said support frame and engageable with the water bottom to advance said frame along the bottom, pipe drive roller supporting means supporting the other side of said frame spaced laterally of said drive track and engageable with each side of the object to be embedded and including at least one drive roller frictionally engageable with the object to be embedded for advancing said frame therealong as said drive track moves said frame relative to the water bottom, and a bottom trenching device carried on said frame between said drive track and said drive roller means and being engageable in the water bottom to form a trench for the object to be embedded as said frame is advanced along said bottom and said object.

14. A device for embedding objects such as continuous lengths of pipes on water bottoms, comprising a support frame, a drive track carried by said support frame and engageable with the water bottom to advance said frame along the bottom, pipe drive roller means on said frame spaced laterally of said drive track and including at least one drive roller frictionally engageable with the object to be embedded for advancing said frame therealong as said drive track moves said frame relative to the water bottom, and a bottom trenching device carried on said frame and being engageable in the water bottom to form a trench for the object to be embedded as said frame is advanced along said bottom and said object, said drive roller means comprising a plurality of groups of rollers arranged at spaced locations along the length of said object to be embedded, pivot support means carrying said drive rollers about an axis extending in the travel direction above the object to be embedded, and hydraulic means connected to said support means for shifting said support means for varying engagement of said drive rollers with the object to be embedded, said drive roller means including a plurality of sets of drive rollers mounted on respective opposite sides of the object to be embedded and symmetrically engaging the object and means biasing said rollers under adjustable hydraulic supply pressure against the object to be embedded, and measuring means carried by said support member for varying said hydraulic supply pressure.

15. A device for embedding objects such as continuous lengths of pipes on water bottoms, comprising a support frame, a drive track carried by said support frame and engageable with the water bottom to advance said frame along the bottom, pipe drive roller means on said frame spaced laterally of said drive track and including at least one drive roller frictionally engageable with the object to be embedded for advancing said frame therealong as said drive track moves said frame relative to the water bottom, and a bottom trenching device carried on said frame and being engageable in the water bottom to form a trench for the object to be embedded as said frame is advanced along said bottom and said object, said drive roller means comprising two sets of rollers mounted in spaced relationship along the length of the support means, said support means comprising a plate coextensive in length with said two sets of rollers and extending to said drive track, said plate forming a triangular support with apex at the drive track.

* * * * *